US006330954B1

(12) United States Patent
Turner et al.

(10) Patent No.: US 6,330,954 B1
(45) **Date of Patent: *Dec. 18, 2001**

(54) CAN END WITH EMBOSS AND DEBOSS SCORE PANEL STIFFENING BEADS

(75) Inventors: Tim L. Turner, Cary, IL (US); Robert L. Hurst, Golden, CO (US)

(73) Assignee: Rexam Beverage Can Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/378,066

(22) Filed: Aug. 20, 1999

Related U.S. Application Data

(63) Continuation of application No. 09/019,920, filed on Feb. 6, 1998, which is a continuation of application No. 08/593,035, filed on Feb. 23, 1996, now Pat. No. 5,715,964.

(51) Int. Cl.[7] ..... B65D 17/32
(52) U.S. Cl. ..... 220/269; 220/906
(58) Field of Search ..... 220/269, 270, 220/272, 273, 906

(56) References Cited

U.S. PATENT DOCUMENTS

| | | |
|---|---|---|
| Re. 31,702 | 10/1984 | Brown . |
| D. 246,229 | 11/1977 | Saunders . |
| D. 250,933 | 1/1979 | Saunders . |
| D. 262,517 | 1/1982 | Hayes . |
| D. 265,463 | 7/1982 | Hasegawa . |
| D. 267,393 | 12/1982 | Gruodis et al. . |
| D. 275,373 | 9/1984 | Brown et al. . |
| D. 364,807 | 12/1995 | Taylor . |
| D. 371,073 | 6/1996 | Taylor . |
| 3,259,265 | 7/1966 | Stuart . |
| 3,291,336 | 12/1966 | Fraze . |
| 3,424,337 | 1/1969 | Von Stocker . |
| 3,900,128 | 8/1975 | Brown . |
| 3,941,277 | 3/1976 | McKinney et al. . |
| 3,967,752 | 7/1976 | Cudzik . |
| 4,084,721 | 4/1978 | Perry . |
| 4,148,410 | 4/1979 | Brown . |
| 4,175,670 | 11/1979 | Reynolds et al. . |
| 4,184,607 | 1/1980 | Potts . |
| 4,205,760 | 6/1980 | Haseqawa . |
| 4,210,257 | 7/1980 | Radtke . |
| 4,266,685 | 5/1981 | Lee, Jr. . |
| 4,313,545 | 2/1982 | Maeda . |
| 4,318,489 | 3/1982 | Snyder et al. . |
| 4,363,419 | 12/1982 | Walz, Sr. . |
| 4,463,866 | 8/1984 | Mandel . |
| 4,465,204 | 8/1984 | Kaminski et al. . |

(List continued on next page.)

FOREIGN PATENT DOCUMENTS

| | | |
|---|---|---|
| 0 564 725 A1 | 10/1993 | (EP) . |
| 704382 A2 | 4/1996 | (EP) . |

OTHER PUBLICATIONS

United States patent application Ser. No. 08/393,140 filed Feb. 21, 1995 for Score Line Groove For Cotainer End Members of Wiliam A. Sedgeley.

InterBev '94 show, Advertising Literature, "Reynolds Develops Large–Opening Ends" Oct. 24, 1994.

"Packaging Priorities", Tim Davis, *Beverage World* Dec. 1994.

*Primary Examiner*—Nathan J. Newhouse
(74) *Attorney, Agent, or Firm*—Wallenstein & Wagner

(57) ABSTRACT

A can end for a two-piece beverage can including a generally flat radially extending portion; a score panel defined in the generally flat radially extending portion by an arcuate score, the score panel having a central, longitudinal axis projecting in a first axial direction and a second axial direction opposite the first direction; an annular emboss bead formed in the score panel and projecting in a first axial direction; and an annular deboss bead formed in the score panel and projecting in the second axial direction.

15 Claims, 12 Drawing Sheets

U.S. PATENT DOCUMENTS

| | | |
|---|---|---|
| 4,524,879 | 6/1985 | Fundon et al. . |
| 4,733,793 | 3/1988 | Moen et al. . |
| 4,804,104 | 2/1989 | Moen et al. . |
| 4,939,665 | 7/1990 | Gold et al. . |
| 5,064,087 | 11/1991 | Koch . |
| 5,129,541 | 7/1992 | Voigt et al. . |
| 5,375,729 | 12/1994 | Schubert . |
| 5,385,254 | 1/1995 | Hannon . |
| 5,456,378 | 10/1995 | DeMars . |
| 5,653,355 | 8/1997 | Tominaga et al. . |
| 5,711,448 | 1/1998 | Clarke, III . |
| 5,715,964 | 2/1998 | Turner et al. . |
| 5,749,488 | 5/1998 | Bagwell et al. . |

CAN END WITH EMBOSS AND DEBOSS SCORE PANEL STIFFENING BEADS

RELATED APPLICATIONS

This application is a continuation of U.S. patent application Ser. Nos. 09/019,920 filed Feb. 6, 1998 (pending) and 08/593,035 filed Feb. 23, 1996 (issued Feb. 10, 1998 under U.S. Pat. No. 5,715,964, the disclosure of which is hereby incorporated by reference and made part hereof.

TECHNICAL FIELD

The present invention relates, generally, to can ends and, more particularly, to a can end having a score panel with emboss and deboss beads provided therein for stiffening the score panel and facilitating proper rupture of the score during opening of the can end.

BACKGROUND OF THE INVENTION

Most beverage cans presently produced in the United States are so-called "two-piece cans" which are typically made from aluminum. A two-piece can includes a can body which has a cylindrical side wall portion and an integrally formed bottom wall portion. The can body is open at the top, terminating in an annular peripheral flange portion. The second component of a two-piece can is a can "lid" or "closure" which is more commonly referred to in the industry as a can "end." The can end has an annular peripheral flange or "curl" portion which is seamed to a corresponding peripheral flange portion of the can body to seal the opening in the can body. The can end is seamed to the can body after the can body has been filled with the desired beverage. Can ends are typically formed in a series of die presses which initially form the basic can end configuration or "shell." Subsequently. the shell has various operations performed thereon, such as embossing, debossing, scoring, rivet formation and tab staking, to complete the end. A can end press is described in U.S. Pat. No. 4,939,665 to Gold et al., issued Jul. 3, 1990, which is hereby incorporated by reference for all that it discloses.

Most can ends used in the packaging of pressurized beverages, such as soft drinks and beer, include a score panel. The score panel may be formed by a pair of closely spaced score lines which are provided in a generally ring-shaped configuration referred to herein as a "score profile." In one popular type of can end, the beginning portion and end portion of the score profile are spaced apart. This spaced apart region does not rupture during opening of the score panel and acts to retain the score panel on the can end after the primary score line has been ruptured. In this type can end, a separately formed tab member has an intermediate portion thereof riveted to a central portion of the can end at a position on the can end adjacent to the score panel. The tab member has a first end portion, generally referred to as a nose, which is initially positioned in contact with the score panel. The tab member has an opposite end portion which is generally formed in a ring-shaped configuration. In opening the can end, a user grasps the ring portion of the tab member and pulls upwardly, causing the tab member to pivot about an axis which is typically adjacent to the rivet on the tab nose end side of the rivet. Thus, pulling upon on the ring end portion causes the nose end portion to be urged against the score panel, causing the score panel to rupture and eventually to pivotally deflect about an axis defined generally by the gap between the beginning and end portions of the score profile. The following U.S. patents disclose various can end configurations and are hereby incorporated by reference for all that is disclosed therein: U.S. Pat. No. Des. 364,807, issued Dec. 5, 1995, to Taylor; U.S. Pat. No. Des. 265,463, issued May 1982 to Hasegawa; U.S. Pat. No. Des. 267,393, issued December 1982 to Gruodis et al.; U.S. Pat. No. Des. 275,373, issued September 1984 to Brown et al.; U.S. Pat. No. 3,259,265, issued July 1966 to Stuart; U.S. Pat. No. 3,291,336, issued December 1966 to Fraze; U.S. Pat. No. 3,424,337, issued January 1969 to Von Stocker; U.S. Pat. No. 4,205,760, issued June 1980 to Hasegawa; U.S. Pat. No. 4,210,257, issued July 1980 to Radtke; U.S. Pat. No. 4,465,204, issued August 1984 to Kaminski et al.; U.S. Pat. No. Des. 246,229, issued November 1977 to Saunders; U.S. Pat. No. Des. 250,933, issued January 1979 to Saunders; U.S. Pat. No. Des. 262,517, issued January 1982 to Hayes; U.S. Pat. No. 4,175,670, issued November 1979 to Reynolds et al; U.S. Pa. No. 4,266,685, issued May 1981 to Lee. Jr.; U.S. Pat. No. 4,313,545, issued February 1982 to Maeda; U.S. Pat. No. 4,318,489, issued March 1982 to Snyder et al.; U.S. Pat. No. 4,733,793, issued Mar. 29, 1988, to Moen et al.; and U.S. Pat. No. 4,804,104, issued Feb. 14, 1988, to Moen et al.; and U.S. application Ser. No. 08/276,331, filed Jul. 15, 1994, for "SCORE LINE GROOVE FOR CONTAINER END MEMBERS" by Sedgeley; and No. 08/393,140, filed Feb. 21, 1995, for "SCORE LINE GROOVE FOR CONTAINER END MEMBERS" by Sedgeley.

Score panel design requires a careful balancing of design parameters. If a designer selects a score line depth which is too deep, the resulting can ends are subject to being ruptured during production and during packaging and shipping operations. On the other hand, if the score depth is too shallow, excessive force may be required to rupture the score. In such a situation, even if the user is physically able to apply sufficient force to rupture the score line, the tab and the score panel itself may deform in a manner to prevent complete rupture of the full length of the score. The tendency of a score panel to deform excessively during score rupture is, to a large extent, a function of the relative stiffness of the score panel. The stiffness of a score panel may, in turn, be influenced by the metal gauge, i.e., the thickness of the score panel, and also the amount of "slack" metal in the score panel. Score panel slack may be produced by various sources, including rivet formation and also the very scoring needed to create a score panel. The relative size of a score panel also affects the rupture performance of a score panel since a panel of larger area tends to bend more and, thus, diffuse the rupture force applied by the tab member more than a smaller score panel of the same metal gauge.

One common technique used for increasing the relative stiffness of a score panel is to create a deboss panel which circumscribes the score panel and rivet. Another technique is to form a raised or "embossed" metal bead in the middle of the score panel to take up metal slack.

SUMMARY OF THE INVENTION

The present invention is directed to a can end for a two-piece beverage can. The can end has a generally flat, radially extending portion. A score panel is defined in the generally flat radially extending portion by an arcuate score. A ring-shaped emboss bead is formed in the score panel. The emboss bead projects upwardly from the score panel. A ring-shaped deboss bead is also formed in the score panel. The deboss bead projects downwardly from the score panel and may encompass the emboss bead. The emboss bead stiffens the score panel and the deboss bead further stiffens the score panel. The stiffening provided by the two beads facilitates proper rupture of the score during opening.

The can end includes a tab which is staked to the generally flat radially extending surface. A nose portion of the tab extends out over the deboss bead and makes contact with a portion of the deboss bead. The deboss bead has a surface portion which ramps upwardly and radially outwardly. The initial point of contact of the tab nose portion with the deboss bead is at a lower portion of the upwardly and outwardly ramping surface. As the score defining the score panel is ruptured, the point of contact of the nose portion moves progressively up the ramped surface, thereby increasing the effectiveness of the tab in applying rupturing force to the score panel. The deboss bead, thus, produces a synergistic effect by both stiffening the score panel and coacting with the tab to increase the tab's effectiveness in applying rupturing force to the score panel. As a result, the end may be scored less deeply than a comparable end which does not have such a deboss, without effecting the relative ease. A score panel of an end with such a deboss ring needs to be scored less deeply than a score panel of a comparable end without such a deboss ring. Thus, the end having the deboss ring maintains a higher score residual and is. therefore, less likely to be prematurely ruptured during production, shipping, etc.

BRIEF DESCRIPTION OF THE DRAWINGS

An illustrative and presently preferred embodiment of the invention is shown in the accompanying drawings in which.

DETAILED DESCRIPTION

Figure 1:
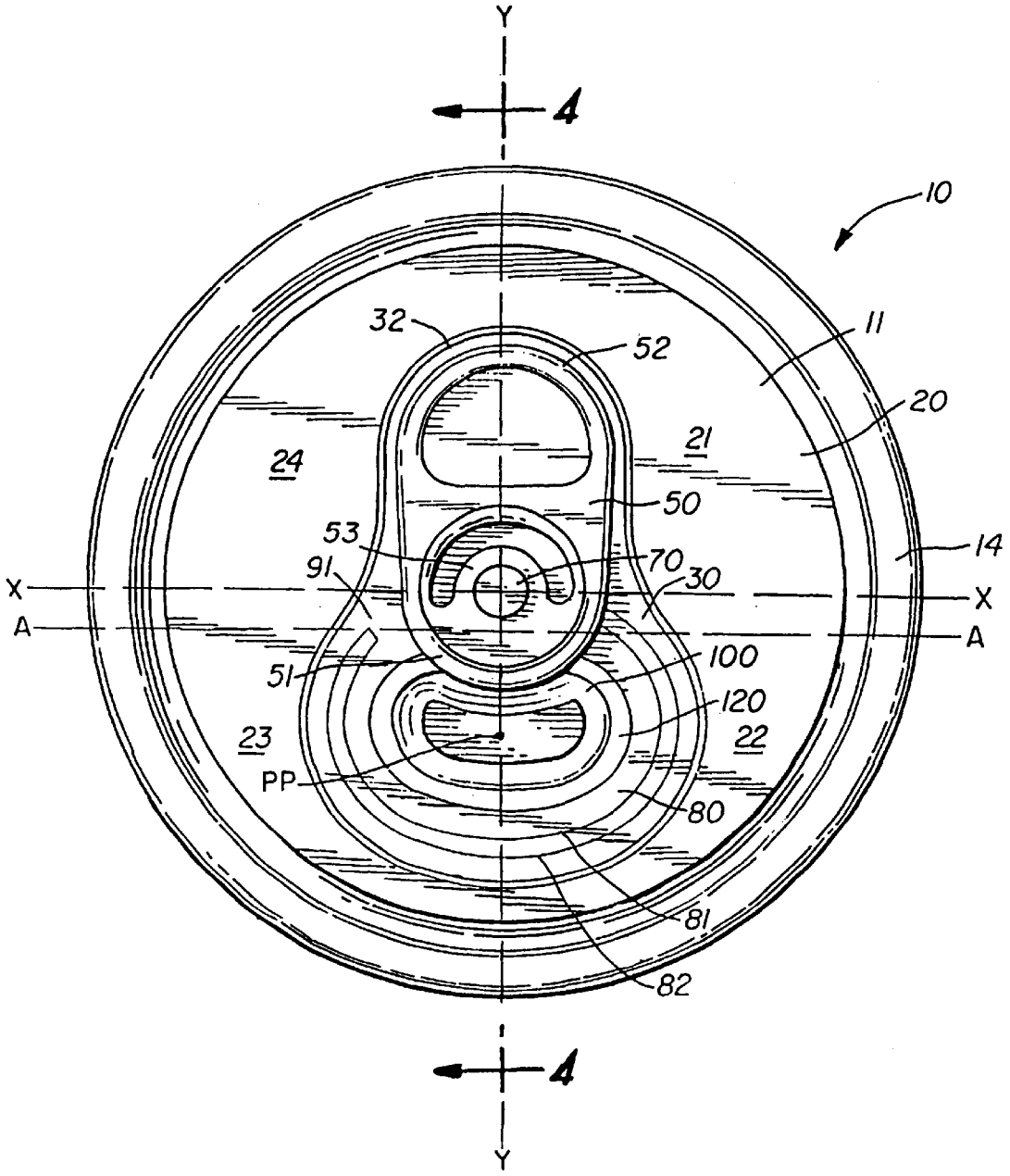
FIG. 1 is a top plan view of a can end.
Figure 2:
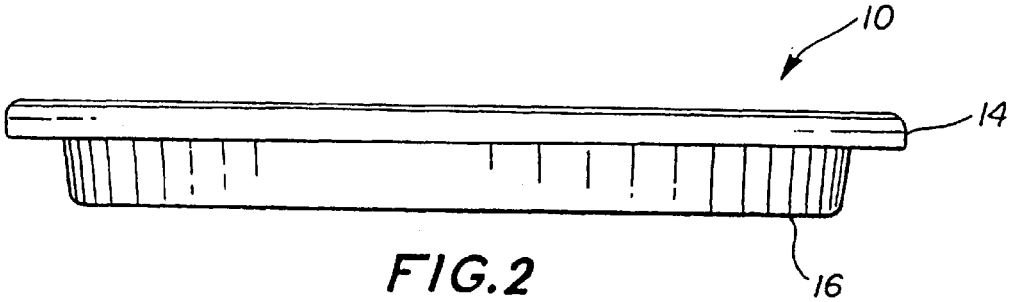
FIG. 2 is a side elevation view of a can end.
Figure 3:
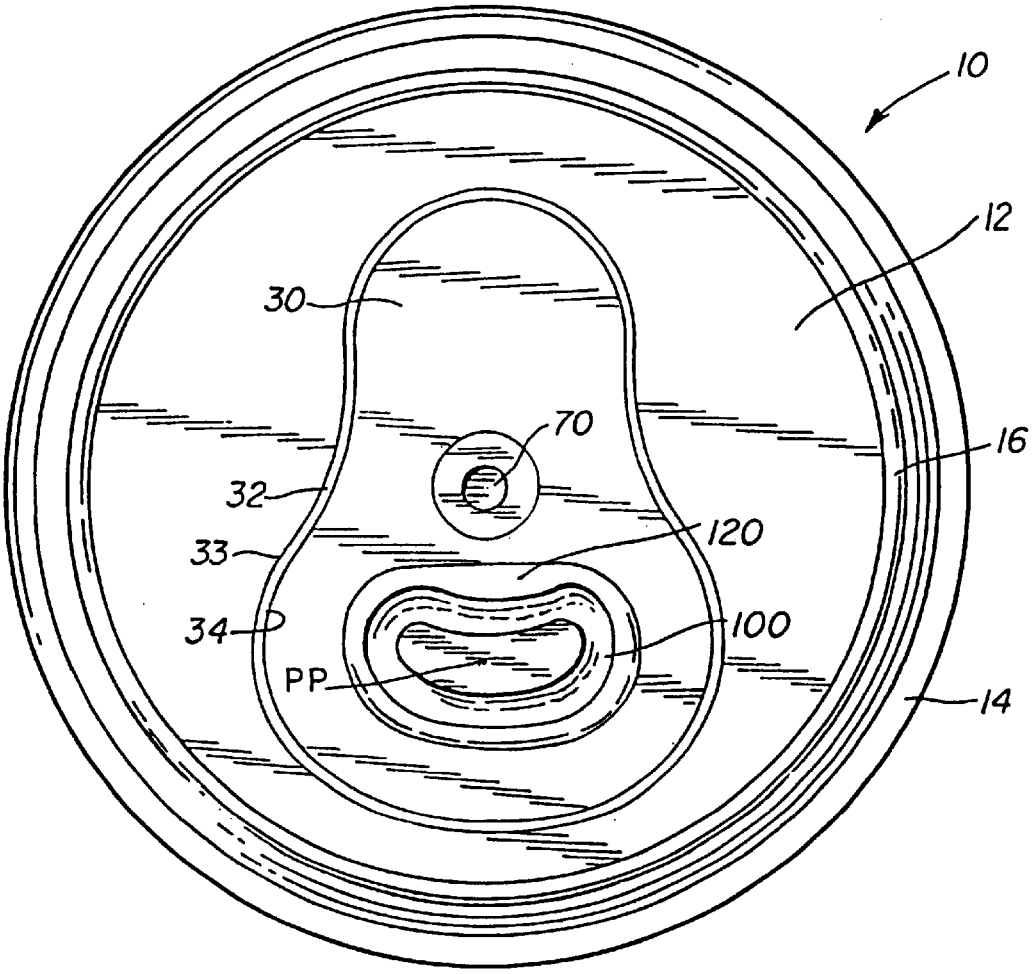
FIG. 3 is a bottom plan view of a can end.

FIGS. 1–5 show various details of a can end 10 for a two-piece beverage can. The can end 10 includes a generally flat, radially extending portion 30 which may be a can deboss panel. A score panel 80 is defined in the generally flat, radially extending portion 30 by an arcuate score 82. An annular emboss 100 is formed in the score panel 80 and projects in a first axial direction 71, FIG. 4. An annular deboss bead 120 is formed in the score panel 80 and projects in a second axial direction 73 opposite to the first axial direction. The annular emboss bead 100 is positioned radially inwardly of the annular deboss bead 120. A pull tab member 50 is attached to the generally flat, radially extending portion 30 and has a nose portion 51. The can end 10 has a first, unruptured., operating position, FIGS. 1, 4 and 5, with the nose portion 51 of the tab member 50 positioned in overlying, engaging relationship with a first, relatively more depressed portion 122 of the annular deboss bead 120. The nose portion 51 is also positioned in overlying, non-engaging relationship with a second, relatively less depressed portion 123 of the deboss bead 120, which is positioned outwardly of the first portion 122. The can end also has a second, partially ruptured operating position with the nose portion 51 of the tab member 50 positioned in non-engaging relationship with the first portion 122 of the deboss bead 120 and in overlying engaging relationship with the second portion 123 of the deboss bead 120.

Having thus described the can end 10 in general, various features of the can end will now be described in further detail and operation of the can end will also be described.

Shell

Figure 4:
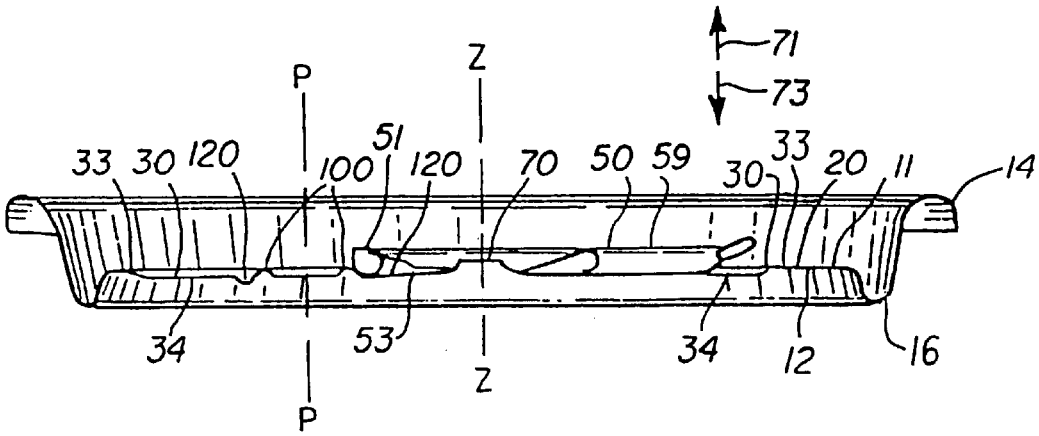
FIG. 4 is a cross-sectional elevation view of a can end.

As best illustrated in FIG. 4, can end 10 is formed from a thin metal shell having a top surface 11 and bottom surface 12. In one preferred embodiment, the can end is of a standard type known in the industry as a "204 end," although this technology may also be applied to larger or smaller can ends. A 204 end has a diameter of two and four sixteenths inches after it is seamed to a can body. The pre-seaming diameter may be 2.452 inches (6.228 cm). In one preferred embodiment, the thickness of the can end metal is preferably between about 0.0085 inches (0.02 cm) and about 0.0095 inches (0.0241 cm) thick and, most preferably, less than 0.0093 inches (0.0236 cm) thick. The can end has a peripheral curl portion 14 and an annular countersink bead 16 of a conventional type used on 204 ends. The total height of the end from the top of the curl to the bottom of the countersink bead may be 0.269 inches (0.683 cm). Integrally connected to the countersink bead 16 is a generally flat, main panel 20 which is also conventional and known in the art. The main panel may be spaced 0.090 inches (0.229 cm) from the bottom of the countersunk bead.

A rivet 70 described in further detail below, is formed at the center of the main panel 20 and has orthogonal axes XX, YY and ZZ as shown in FIGS. 1 and 4. Axes XX and YY define a plane parallel to panel 20 and divide the can end into first, second, third and fourth quadrants 21, 22, 23, 24.

Deboss Panel

Figure 6:
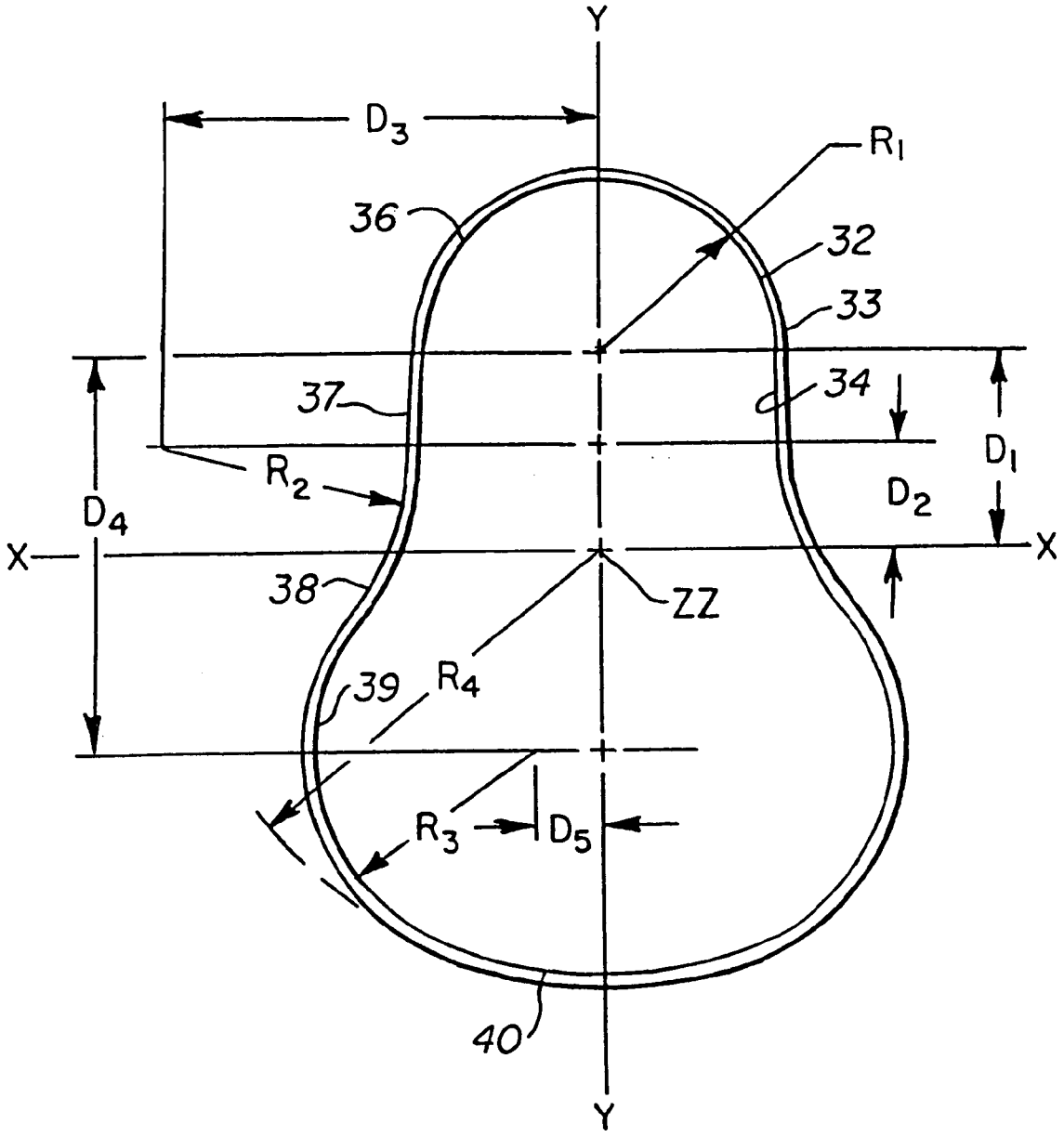
FIG. 6 is a top plan view of a can end deboss panel.

A deboss panel 30, as best shown in FIGS. 1, 3, 4 and 6, is formed in the main panel 20 using conventional die-forming techniques. The deboss panel 30 has a generally, pear-shaped deboss profile 32 which is, in turn, defined by an outer radius line 33 and an inner radius line 34. The outer radius line may have a radius of 0.015 inches (0.038 cm) with a center of curvature below bottom surface 12 and the inner radius line may have a radius of 0.015 inches (0.038 cm) with a center of curvature above top surface 11. The depth of the deboss profile, i.e., the vertical distance between outer radius line 33 and inner radius line 34 may be about 0.019 inches (0.048 cm). The width of the deboss profile, i.e., the lateral distance between the outer and inner radius lines, may be about 0.015 inches (0.038 cm). The deboss panel has bilateral symmetry with respect to a plane defined by axes YY and ZZ. In view of the bilateral symmetry of the pear-shaped. deboss profile, only one-half of the deboss profile will be described since the opposite half is a mirror image thereof. The deboss panel, as shown by FIG. 6, includes a first arcuate portion 36 having a radius of curvature $R_1$ (as measured to the inner radius line 34) of 0.3420 inches (0.0868 cm). Portion 36 is connected to a second, straight portion 37 which is, in turn, connected to a third, arcuate portion 38 having a radius $R_2$ of 0.5000 inches (1.27 cm). Portion 38 is connected to a fourth, arcuate portion 39 having a radius $R_3$ of 0.4350 inches (1.105 cm). Portion 39 is, in turn, connected to a fifth, arcuate portion 40 having a radius $R_4$ of 0.8507 inches (2.161 cm) having a center of curvature located at the rivet centerline. The centers of curvature of the other arcuate portions are indicated by the dimensions $D_1$–$D_5$ which may be as follows: $D_1$=0.3940 inch (1.0033 cm); $D_2$=0.2112 inch (0.5364 cm); $D_3$=0.8420 inch (2.1387 cm); $D_4$=0.7889 inch (2.0038 cm); and $D_5$=0.130 inch (0.3302 cm).

Tab

As best illustrated in FIGS. 1 and 4, a tab 50 is attached to the can end by central annular rivet 70. The tab 50 has a rounded nose portion 51 at one end (which may have a radius of curvature of about 0.500 inches (1.27 cm)), a ring-pull portion 52 at the opposite end, and an intermediate portion 53 which is staked to the end by center rivet 70. The nose portion 51 is formed, in part, by a nose curl 56 best illustrated in FIG. 5. A lower surface portion 57 of the nose curl makes contact with a lower portion 122 of annular deboss bead 120 as described in further detail below. The tab member 50 (sometimes referred to herein simply as "tab"), in operation, pivots about a tab pivot axis AA which is positioned parallel to axis XX at a position adjacent to the rivet 70, as best illustrated in FIG. 1. The tab member has an annular, inner peripheral edge 58 positioned next adjacent central rivet 70, FIG. 5. The tab, in one preferred embodiment, has a nose thickness, $D_{10}$), FIG. 5, of about 0.070 inch (0.1778 cm). The nose thickness is about 8% to 20% thicker than the thickest region of the pull ring and, most preferably, should be about 9% to 12%, or at least 0.004 inch (0.0102 cm), thicker. The radial distance, $D_{11}$, from the nose contact point 57 to the rivet centerline ZZ, may be about 0.490 inch (1.2446 cm). The tab member may have a length of about 0.990 inch (2.5146 cm) and, with the exception of its nose thickness, may be identical to most tabs currently used on beverage cans. The tab width may be about 0.625 inch (1.5875 cm).

Rivet

Figure 5:
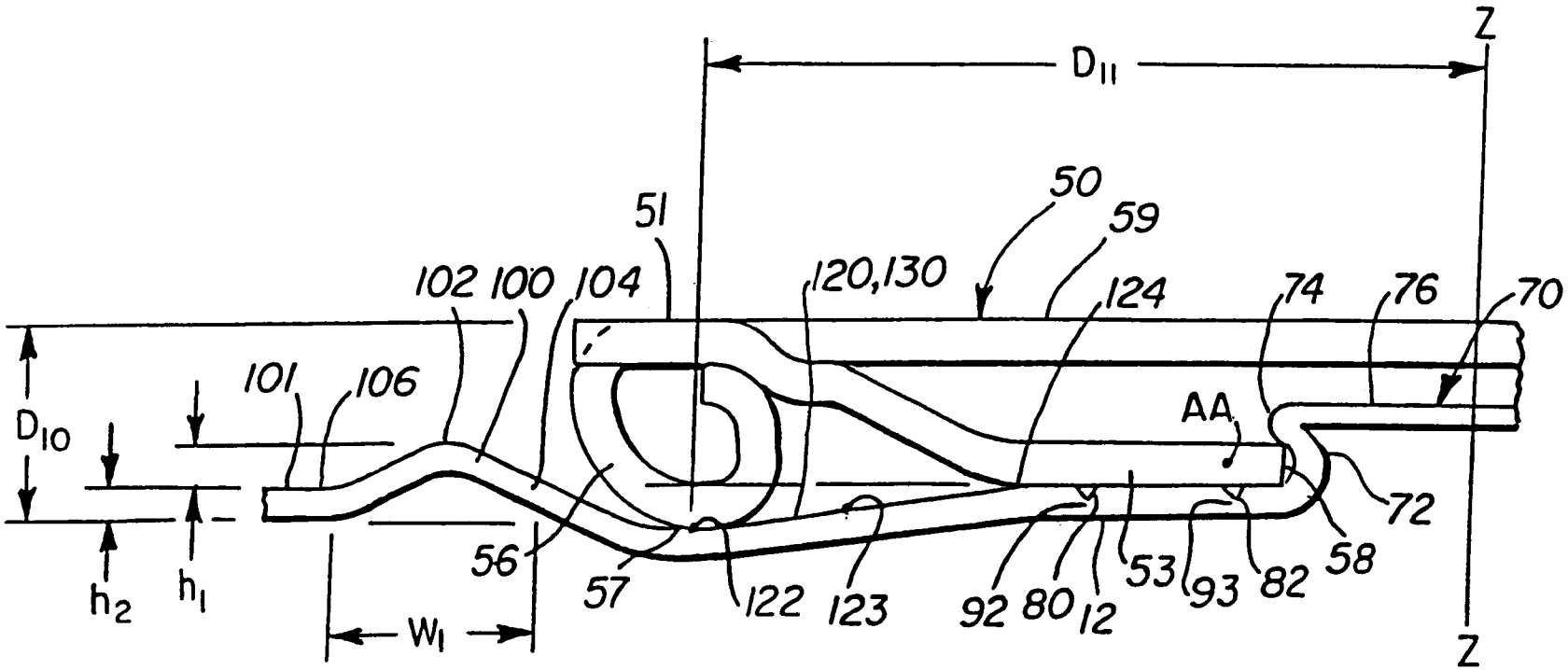
FIG. 5 is a detail cross-sectional elevation view of a can end.

As best illustrated by FIGS. 1, 4 and 5, central annular rivet 70 comprises an upright portion 72, which is joined through a shoulder portion 74 to an upper head portion 76 of the rivet. The annular, inner peripheral edge 58 of the tab is positioned next adjacent to the upright portion 72 in touching or near touching contact therewith. The shoulder portion 74 extends radially outwardly above the peripheral edge 58 of the tab, thus securing the tab member 50 to the can end 10.

Score Panel

Figure 7:
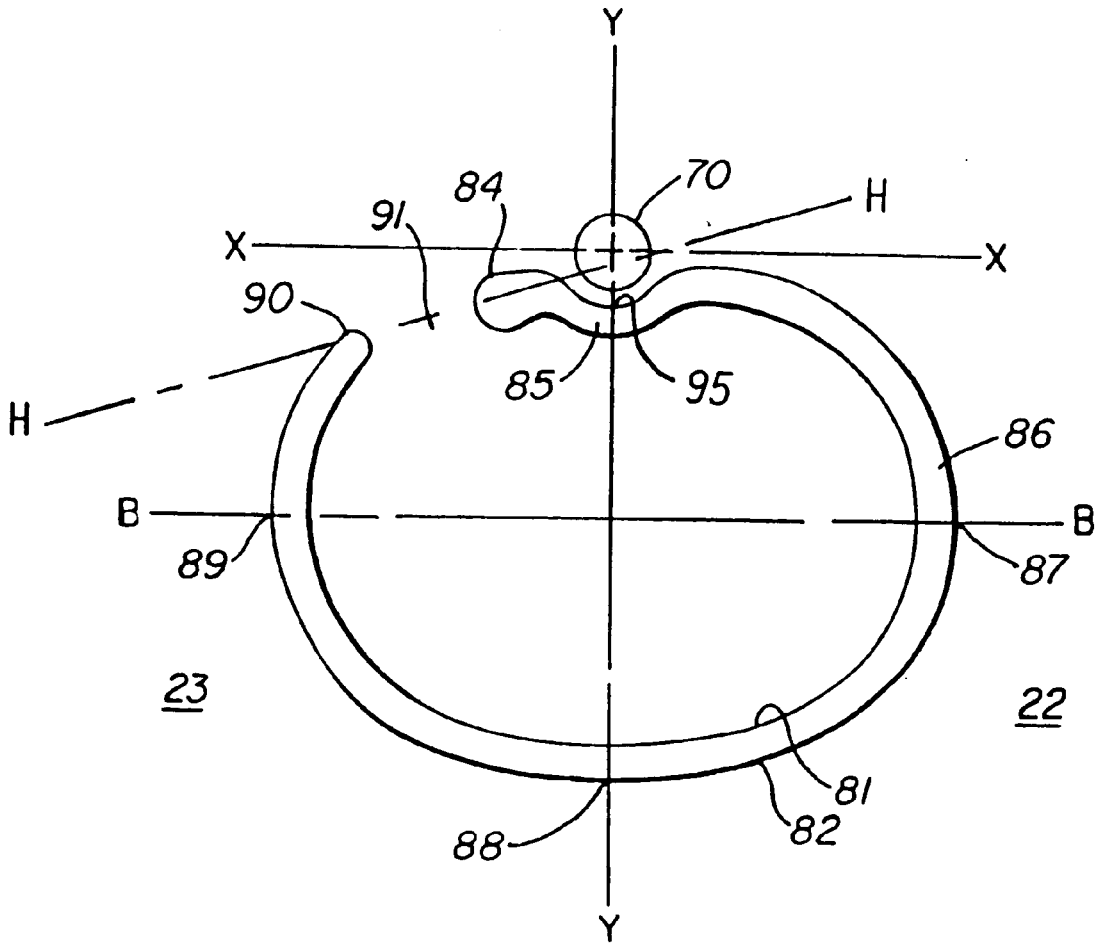
FIG. 7 is a top plan view of a can end score profile and rivet.

A score panel 80 is defined by a score profile 83 which is, in turn, defined by inner, antifracture score 81 and outer, primary score 82, as best illustrated in FIG. 7. However, this invention can also be used on ends with only a primary score. The score panel has a central longitudinal axis PP which is parallel to axis ZZ. The score profile includes an enlarged first end portion 84 positioned near rivet 70 in the third quadrant 23 of the can end. An arcuate portion 85 is connected to end portion 84 and has a shape which is generally concentric to the outer edge surface of rivet 70, which is positioned in the second and third quadrants 22, 23, respectively. A generally elliptical portion 86 is connected to portion 85 and comprises a 3 o'clock position 87, a 6 o'clock position 88, a 9 o'clock position 89, and a 12 o'clock position 95. The 3 o'clock and 9 o'clock positions define an axis BB perpendicular to axis YY. The 6 o'clock position 88 and the 12 o'clock position lie on axis YY. The radial distance between the primary score 82 and the inner radius line 34 of the deboss panel may be constant from the 3 o'clock through the 6 o'clock and 9 o'clock positions, and may be about 0.150 inch (*0.381 cm). Generally elliptical portion 86 terminates at second end portion 90, which terminates short of first end portion 84. The gap 91, between the first and second end portions 84, 90, which may be about 0.110 inch (0.2794 cm) long, defines a hinge axis HH about which the score panel 80 ultimately pivots after the score profile is fully ruptured. The antifracture score may have a score residual 92 slightly more than the primary score. The primary score may have a score residual 93 of between 0.0028 inch (0.0071 cm) and 0.0040 inch (0.0102 cm) and, most preferably, about 0.0030 inch (0.0075 cm) to 0.0038 inch (0.0097 cm) for a can end having a thickness of about between 0.0084 inch (0.0213 cm) and 0.0098 inch (0.0249 cm) and, most preferably, 0.0088 inch (0.02235 cm). The "score residual" refers to the distance between the bottom of the score and bottom surface 12. The dimension of the major score profile axis BB, i.e. from the 3 o'clock to the 9 o'clock position of the primary score, may be about 1.00 inch (2.54 cm). The dimension along axis YY from the centerline of the rivet to the 6 o'clock position of the primary score may be about 0.79 inch (2.0066 cm).

Emboss Bead

The configurations of annular emboss bead 100 and annular deboss bead 120 are illustrated in FIGS. 1, 4, 5 and 8. The emboss bead 100 has a central crest portion 102 which may have a height $h_1$, FIG. 5, above the adjacent, inwardly-positioned, flat top surface portion 101 of deboss panel 30 of 0.003 to 0.015 inch (0.0076–0.0381 cm) and, preferably, 0.004 to 0.010 inch (0.0102–0.0254 cm) and, most preferably, 0.005 to 0.008 inch (0.127–0.0203 cm). The emboss bead 100 comprises an outer peripheral edge 104 which begins a transition into the deboss bead 120. The emboss bead 100 also comprises an inner edge 106. As shown in FIG. 5, the emboss bead width $w_1$, between the outer and inner edges 104, 106, may be about 0.046 inch (0.1168 cm).

Figure 8:
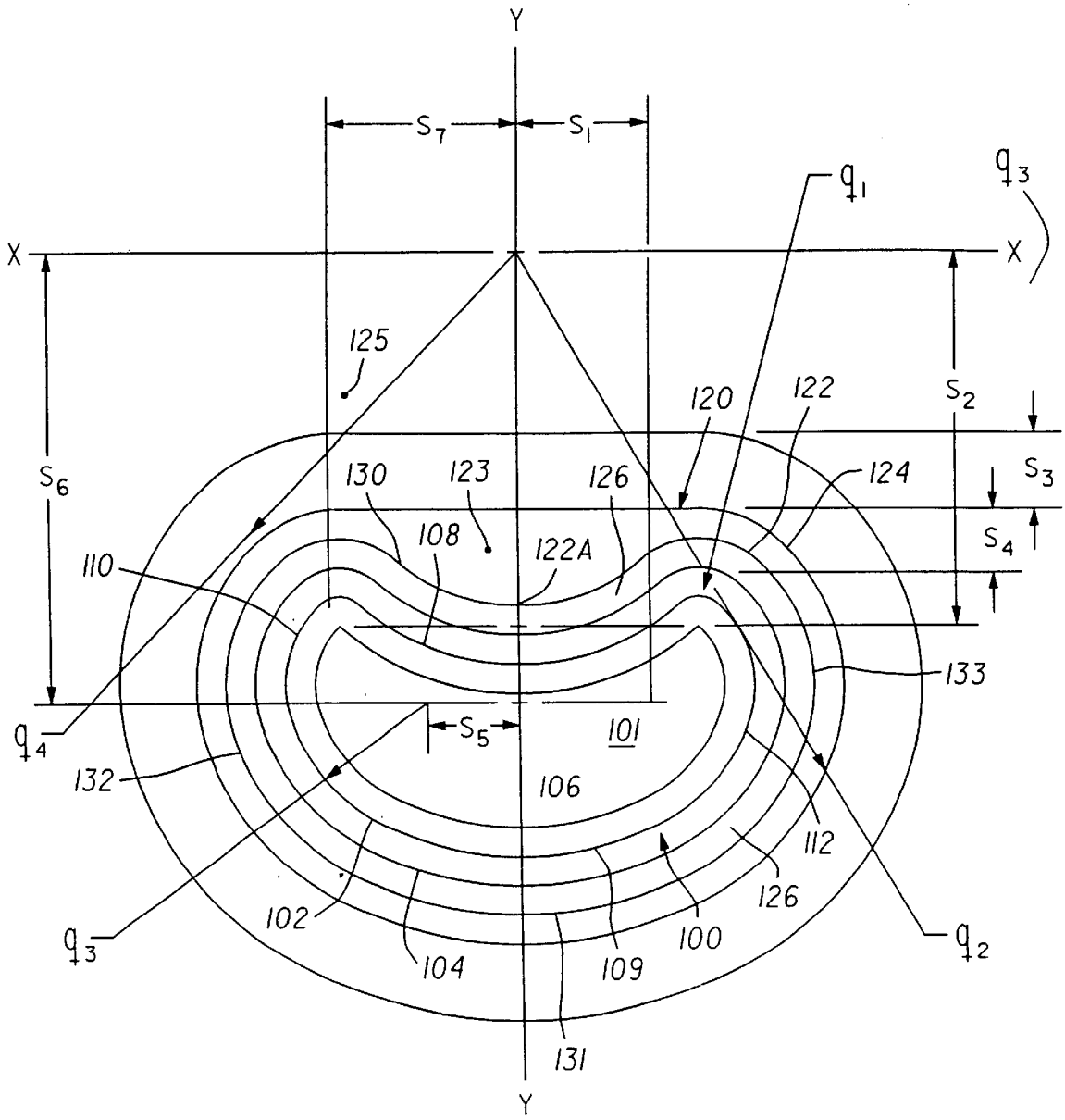
FIG. 8 is a top plan view of a score panel emboss bead and deboss bead.

The annular emboss bead 100 may have a first, inwardly convex portion 108, FIG. 8, which is concentric with the end curvature of adjacently positioned nose 51 of tab 50, FIG. 1. The emboss bead may have a second portion 109, FIG. 8, which is positioned opposite the first portion 108 and which is outwardly convex and generally concentric with the first portion. The emboss bead 100 may comprise a third portion 110 which is outwardly convex and integrally connected to the first and second portions, and may further comprise a fourth portion 112 positioned opposite the third portion 110 which is a mirror image thereof.

Deboss Bead

With further reference to FIGS. 4, 5 and 8, annular deboss bead 120 has a first annular region 122 at which the bead has its lowest depth below flat surface 101. In one preferred embodiment, the depth $h_2$, FIG. 5, of region 122 below surface 101 is constant around the bead circumference and may be about 0.003 to 0.015 inch (0.0076–0.0381 cm) and, preferably, 0.005 to 0.008 inch (0.0127–0.0203 cm). Deboss bead 120 also comprises a second annular region 124 at which the bead transitions into the surrounding flat portion of the can end. This annular region 124 represents the greatest height of the bead at any circumferential position therealong. The annular deboss bead 120 also comprises a transition region 126 between lowermost annular region 122 and outer edge 104 of the emboss bead.

Annular deboss bead 120 includes a first circumferential portion 130 positioned opposite circumferential portion 108 of the emboss bead. First circumferential portion 130 is generally arcuate in annular regions 122 and linear in region 124. The annular deboss bead has a second circumferential portion 131 positioned next adjacent emboss bead portion 109 and concentric therewith. The annular deboss bead further includes third and fourth circumferential portions 132, 133 which are positioned adjacent emboss bead portions 110 and 112, respectively, in concentric relationship therewith.

In one preferred embodiment, the radii of curvature $q_1$–$q_4$ and various distances $S_1$–$S_7$, as illustrated in FIG. 8, may be as indicated in Tables I and II, $q_1$ represents the radius of curvature at the center line of the emboss bead at the point indicated; $q_2$ is the radius of curvature of an arc (not shown( passing through the center line of the emboss bead portion 109 at its intersection with axis YY; $q_3$ is the radius of curvature at the center line of the emboss bead at the point indicated; $q_4$ is the radius of curvature of an arc (not shown) passing through the center line of the emboss bead portion 108 at its intersection with axis YY. $S_3$ is the width of an excess metal region which circumscribes the emboss bead and deboss bead.

TABLE I

| |
|---|
| $s_1$ = 0.1300 inch (0.3302 cm) |
| $s_2$ = 0.3243 inch (0.8237 cm) |
| $S_3$ = 0.074 inch (0.1880 cm) |
| $S_4$ = 0.056 inch (0.1422 cm) |
| $S_5$ = 0.130 inch (0.3302 cm) |
| $s_6$ = 0.3949 inch (1.0030 cm) |
| $s_7$ = 0.2037 inch (0.5174 cm) |

TABLE II

| |
|---|
| $q_1$ = 0.0380 inch (0.7823 cm) |
| $q_2$ = 0.5557 inch (1.4115 cm) |
| $q_3$ = 0.1400 inch (0.3556 cm) |
| $q_4$ = 0.3450 inch (0.8763 cm) |

Operation

Figure 9:
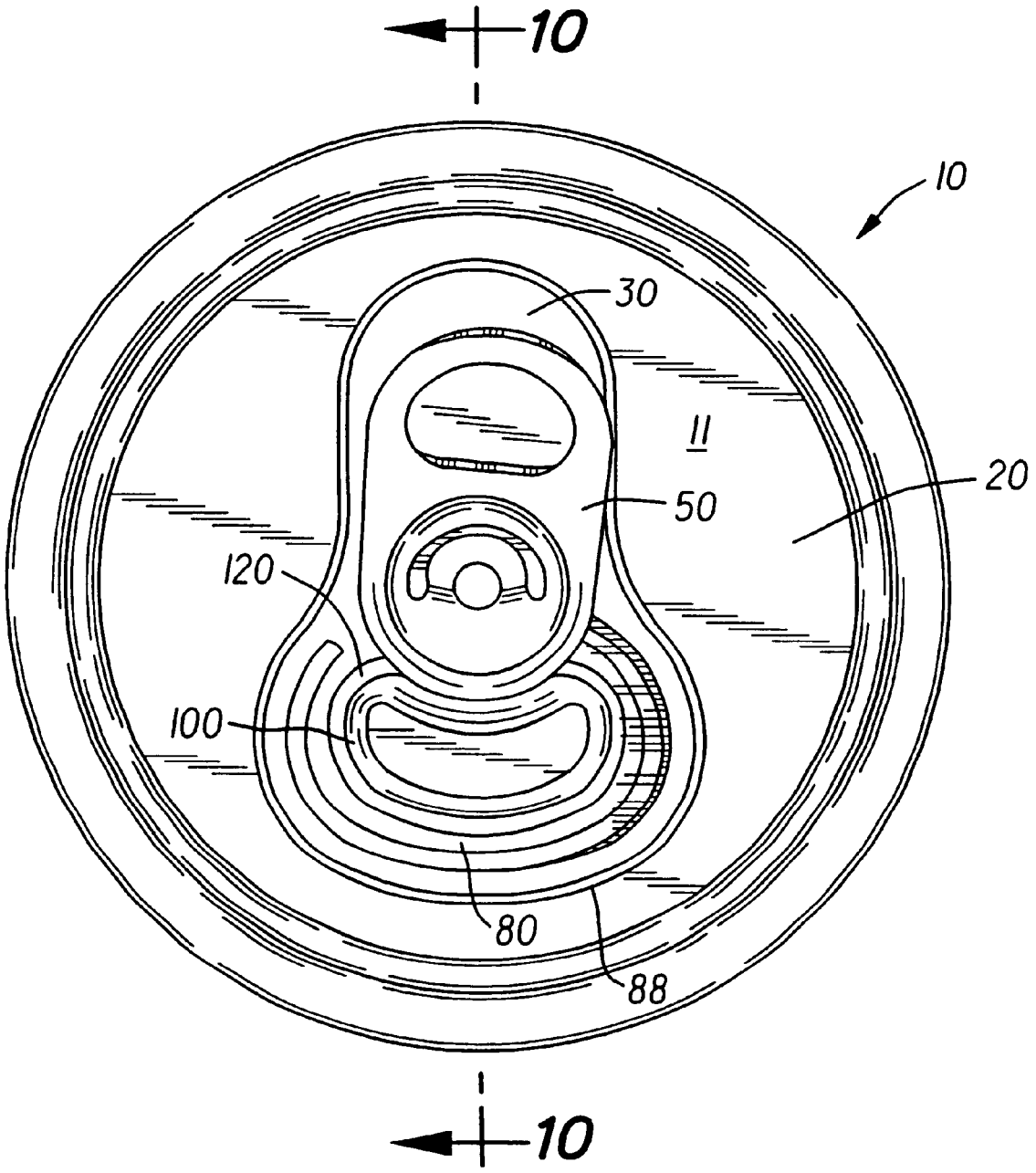
FIG. 9 is a top perspective view of a can end which has been ruptured to approximately the six o'clock position.
Figure 10:
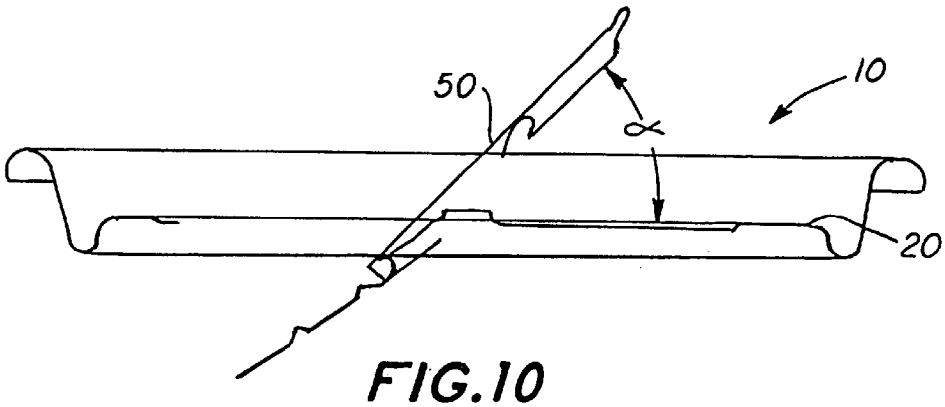
FIG. 10 is a side elevation view of the ruptured can end of FIG. 9.
Figure 11:
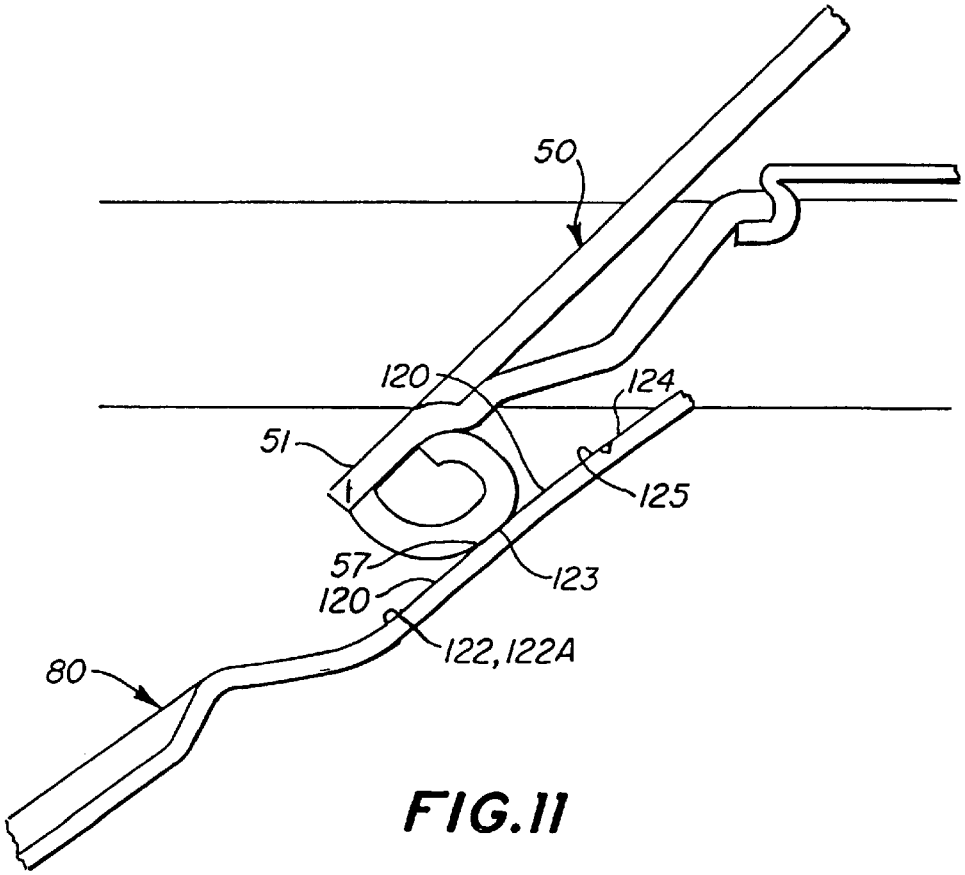
FIG. 11 is a detail side elevation view of the ruptured can end of FIGS. 9 and 10 showing only a cross-sectional portion of the score panel.

Opening of a can end 10 having the above configuration will now be described. As illustrated in FIGS. 1, 4 and 5, in an initial, undisturbed state, an upper surface 59 of the tab is generally parallel to the top surface 11 of the can main panel 20. A lower surface 57 of tab nose 51 is positioned in contact with a lower annular region 122 of annular deboss 120, FIG. 4. The contact point 57 is primarily at the centerline of the tab, i.e., in plane YY, ZZ. Upward pressure on the ring-end portion 52 of tab 50 causes tab 50 to pivot about axis AA, FIGS. 1 and 5, urging nose portion 51 downwardly and causing primary score 82 to begin rupturing at the 12 o'clock position 91 of the score profile and propagates outwardly towards both ends of the score panel. The relative position of the tab and score panel, after rupture has progressed to approximately the 6 o'clock position 88. FIG. 7, is illustrated in FIGS. 9. 10 and 11. As best shown by FIG. 10, the tab may have been rotated through an angle $\alpha$ of approximately 45 degrees to produce this amount of rupture. The actual deflection of the tab will, to a certain extent, depend upon the dynamic loading on the end which is, in turn, influenced by the speed at which the tab is lifted by the user. The relative thickness of the score panel, the score depth residual and other factors, such as metal grain direction and characteristics of the metal sheet stock, will also have an effect on the amount of tab rotation necessary to produce a fracture to 6 o'clock. As best shown by FIG. 11, the tab end contact point 57 has moved inwardly from lower region 122 to an intermediate position 123 between lower region 122 and elevated region 124 of the annular deboss 120. Due to the fact that point 123 is at a higher elevation than original contact point 122, the amount of tab deflection $\alpha$ is less than that which would have been required if location 123 were originally at the same elevation as region 122. Thus, to repeat, tab contact point 57 has moved up the gradually raised (ramped) surface of deboss 120 during the rupture of score 80 from the beginning thereof to the 6 o'clock position 88. The tab 50 has applied force to the score panel more effectively as a result of its travel over the deboss ramped surface than it would have applied had it moved over a flat surface. It should also be noted that the contact point 57 has shifted slightly to the left of axis YY as a result of deflection of the score panel into the opening 152 which has been formed as a result of this portion of the rupture. This may best be seen in FIG. 8, where 122A shows the point of initial contact associated with FIGS. 1, 4 and 5, and point 123 shows the contact point associated with FIGS. 9, 10 and 11.

Figure 12:
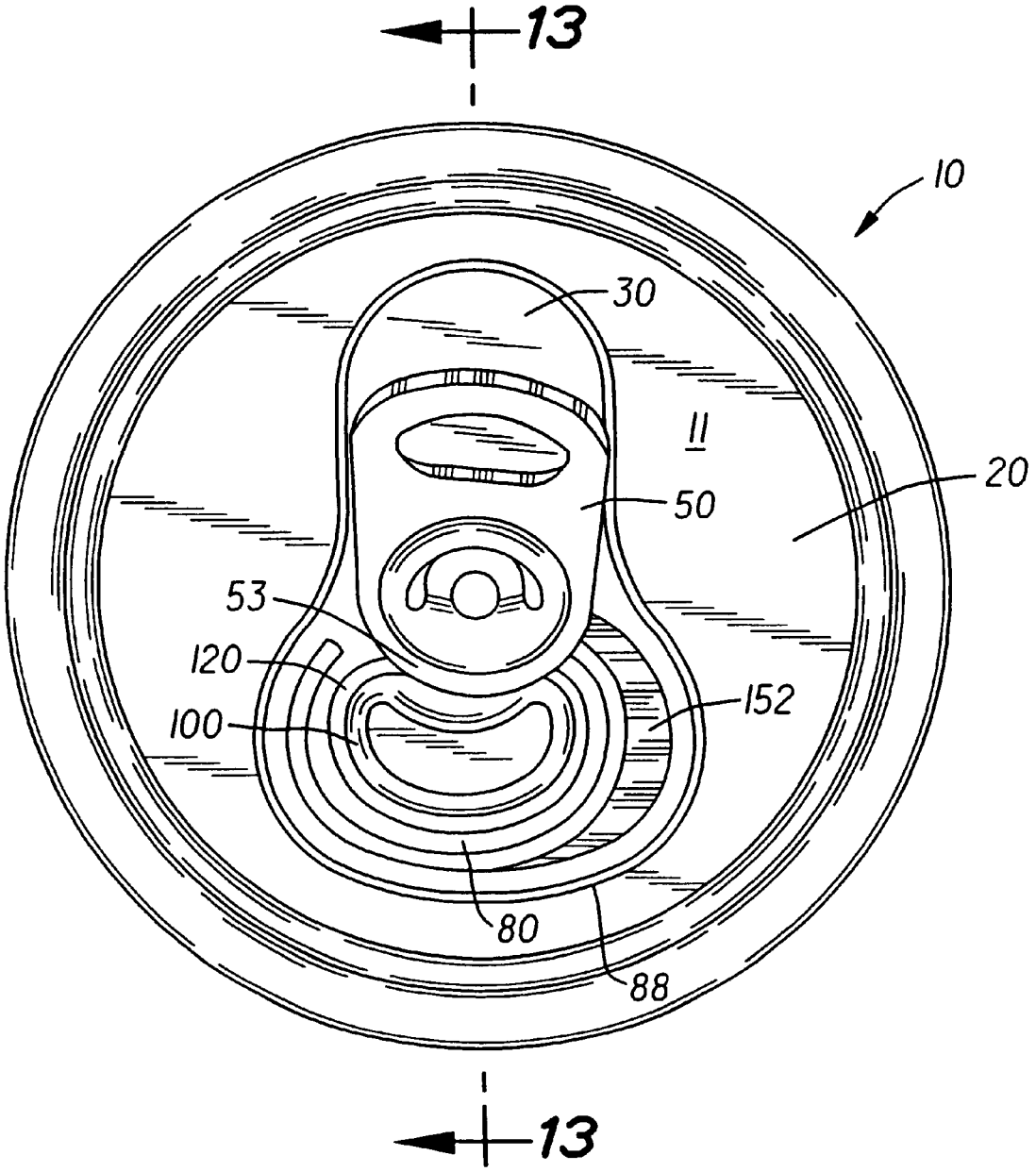
FIG. 12 is a top perspective view of a can end which has been ruptured to approximately the nine-o'clock position.
Figure 13:
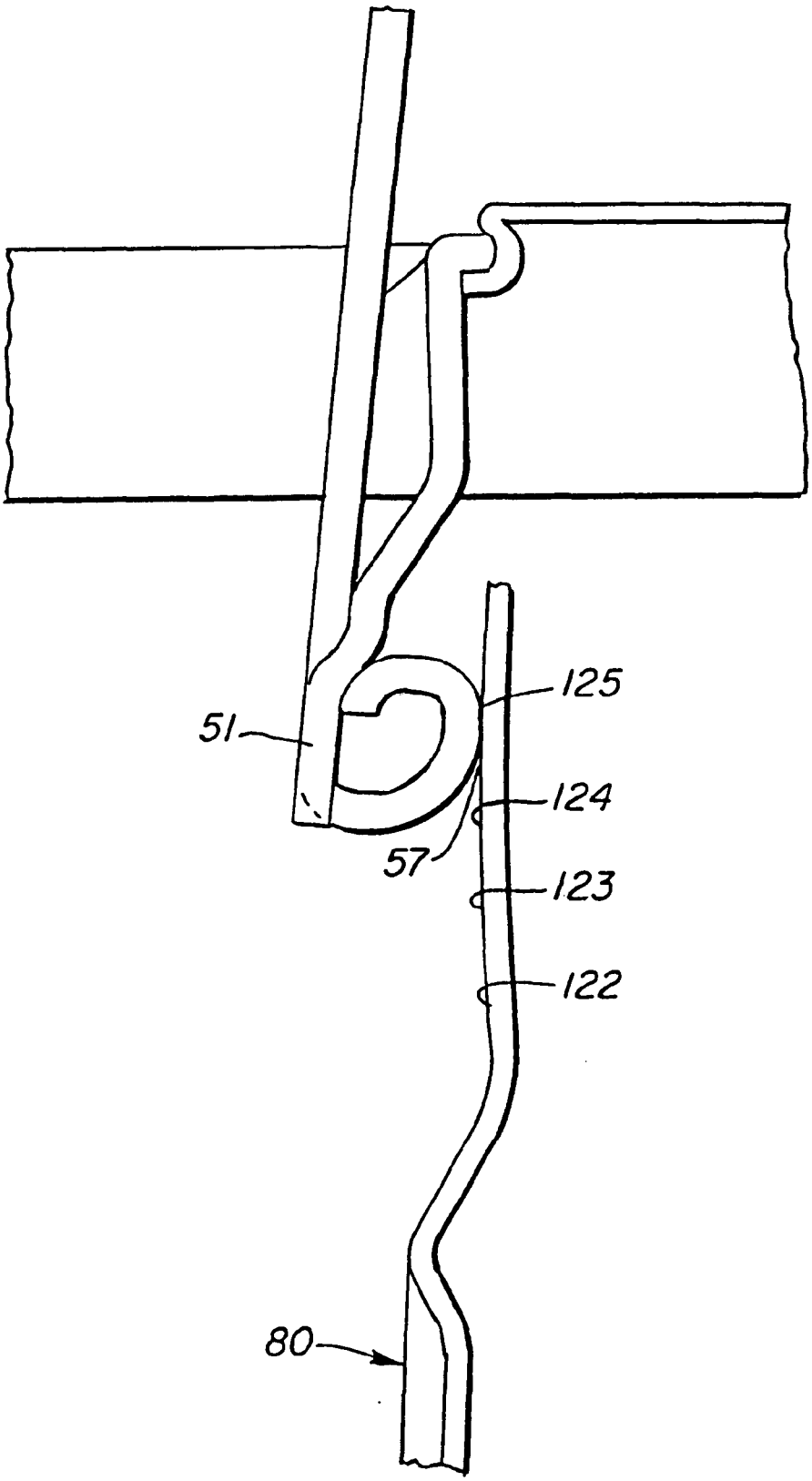
FIG. 13 is a detail side elevation view of the ruptured can end of FIG. 12 showing only a cross-sectional portion of the score panel.

FIGS. 12 and 13 illustrate the relative position of the tab and score panel after rupture has progressed to the 9 o'clock position 89. It will be seen that in FIGS. 12 and 13, the tab 50 is positioned nearly perpendicular to the plane of the main panel 20. It may be seen from FIG. 13 that, in this state, the contact point of tab nose 51 has moved slightly beyond the uppermost elevation 124 of the deboss ring to contact point 125. Again, due to the initial difference in elevation between the upper and lowermost regions of the deboss ring 122, 124, respectively, the tab 50 has applied force to the score panel 80 more effectively than it would have had it moved over a conventional flat surface rather than the ramped, deboss surface. In addition to the reduction in angular displacement and more effective application of force by the tab which is provided by the deboss geometry, a further efficiency in angular displacement is afforded due to the fact that the score panel 80 has been additionally stiffened by the annular deboss bead 120. Without this additional stiffening, the score panel 80 would have an increased tendency to bend rather than rupture, particularly in the score profile region between 6 o'clock and 9 o'clock. Thus, the presence of the deboss ring 120 significantly and synergistically improves the rupture performance of the can end 10.

It should also be noted that the generally pear-shaped configuration of the deboss panel 30, which closely follows the score profile, is believed to enhance score rupturing by taking up metal slack near the rivet 70 and also immediately adjacent to the score along its entire length from the 6 o'clock through past the 9 o'clock position, the region where score rupture failure is most likely to occur.

Figure 14:
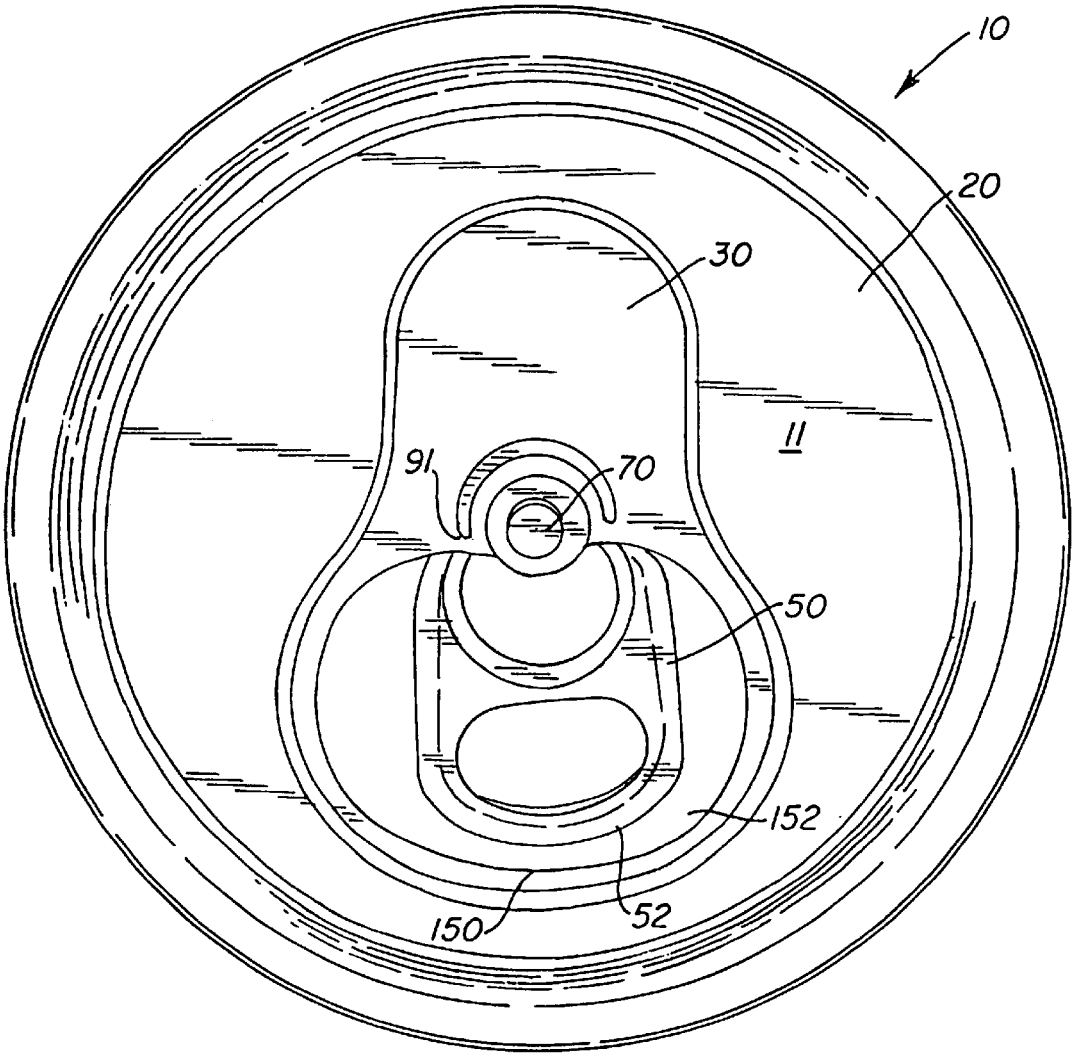
FIG. 14 is a top perspective view of a fully ruptured can end.
Figure 15:
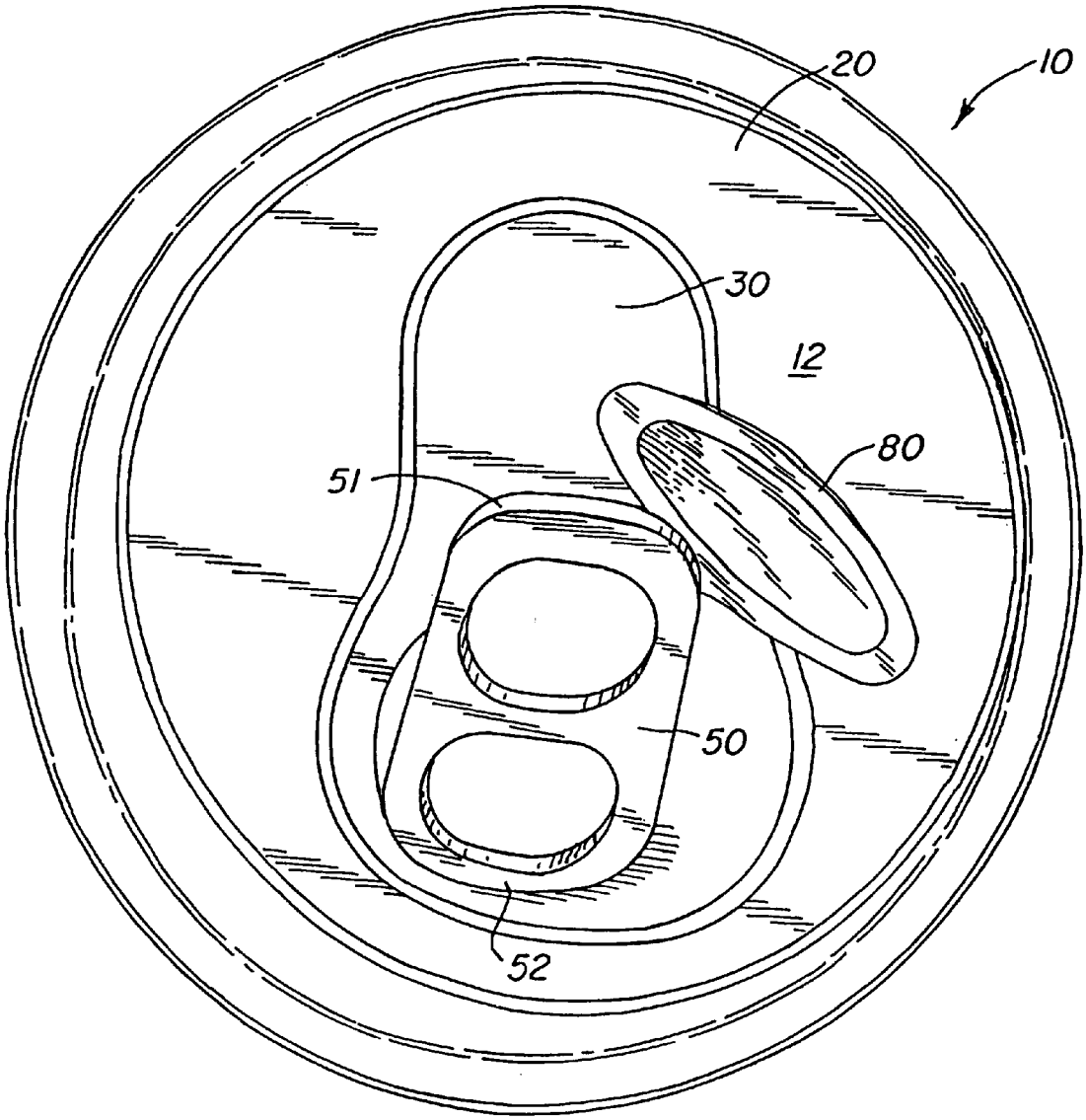
FIG. 15 is a bottom perspective view of a fully rupture can end.

As illustrated by FIGS. 14 and 15, continued rotation of the tab 50 to a point in touching or near contact with a peripheral edge 150 of the can opening 152 causes the score panel 80 to be rotated to a position approximately perpendicular to the bottom surface 12 of the main panel 20 of the can end. At this position, the score panel has been fully ruptured around the score profile 83 such that only the metal end gap region 91 maintains the score panel 80 on the can end 10. It will also be seen from FIG. 15 that the contact point of the score panel with the nose portion 52 of tab 50 has moved still further from the center to axis YY and has moved still further radially outward relative to the center of score panel 80. The tab 50 is next rotated back to its original position of FIG. 1, leaving score panel 80 in the position illustrated in FIG. 15 and leaving opening 152 unobstructed.

Thus, as a result of using emboss ring 100 in combination with deboss ring 120, a significant improvement in rupture force application is achieved which allows a score panel to be formed having an increased score residual 93 over that required for a similar can end having only an emboss ring 100. Therefore, a much larger score panel. e.g., a score panel with an area of about 0.67 square inches (1.7018 cm), may be created while using the same score residual as that of a much smaller, standard-sized score panel. Accordingly, a can end 10 which is not subject to panel rupture during manufacture and shipping, and yet remains easy to open and which may have a relatively large opening area, is provided.

It is contemplated that the inventive concepts herein described may be variously otherwise embodied, and it is intended that the appended claims be construed to include alternative embodiments of the invention except insofar as limited by the prior art.

We claim:

1. A can end for a two-piece beverage can, comprising: a generally flat radially extending portion;

a score panel defined in said generally flat radially extending portion by an arcuate score; said score panel having a central longitudinal axis projecting in a first axial direction normal to said generally flat radially extending portion and a second axial direction opposite to said first axial direction; and, a depression formed in said score panel and projecting in said second axial direction, a pull tab attached to said generally flat radially extending portion, said pull tab residing in a resting state without user lifting force applied, and having a nose portion position in overlying relationship with a portion of said depression and said nose portion being engaged with a portion of said depression.

2. The can end of claim 1 wherein said depression comprises a ramp surface portion.

3. The can end of claim 2 wherein said ramp surface portion ramps in said first axial direction and radially outwardly on the score panel.

4. The can end of claim 1 wherein said nose portion of said tab is thicker than the remainder of said tab.

5. The can end of claim 1 wherein said tab comprises a ring end portion positioned opposite said nose portion and wherein the thickest region of said nose portion is at least 9% thicker than the thickest region of said ring end.

6. The can end of claim 1 wherein the depression comprises an annular depression with a first region of lowest depth and a second region of a lesser depth.

7. A can end for a two-piece beverage can, said can end having a central longitudinal axis, comprising;

a generally flat radially extending portion and a score panel defined in said generally flat radially extending portion by an arcuate score, a pull tab attached to said generally flat radially extending portion; said pull tab having a nose portion at a first end and a pull ring portion at a second end;

a depressed region formed in said score panel and having at least a portion of said depressed region positioned under said nose portion of the pull tab;

the can end further comprising a first unruptured, operating position with said nose portion of said tab positioned in overlying, engaging relationship with a first, relatively more depressed portion of said depressed region and in overlying, non-engaging relationship with a second, relatively less depressed portion of depressed region position adjacent of said first portion of said depressed region; and, a second, partially ruptured, operating position with said nose portion of said tab positioned in non-engaging relationship with said first portion of said depressed region and in overlying, engaging relationship with said second portion of said depressed region and said pull ring portion in spaced apart relationship with said generally flat, radially extending portion.

8. The can end of claim 7 further comprising a third partially ruptured operating position with said score line ruptured more completely than in said second operating position and with said nose portion of said tab positioned in non-engaging relationship with said depressed region and in overlying, engaging relationship with a portion of said score panel positioned radially inwardly of said depressed region.

9. The can end of claim 8 wherein said nose portion of said tab is thicker than the remainder of said tab.

10. The can end of claim 8 wherein the thickest region of said nose portion is at least 9% thicker than the thickest portion of said pull ring portion.

11. The can end of claim 8 wherein the thickest region of said nose portion is 8–20% thicker than said pull ring portion.

12. The can end of claim 8 wherein the thickest region of said nose portion is at least 0.004 inches thicker than the thickest region of said pull ring portion.

13. The can end of claim 7 wherein said depressed region comprises an upwardly and radially outwardly ramping surface of the score panel, the difference in elevation between the lowest point and the highest point thereon being between 0.003 inch and 0.010 inch.

14. The can end of claim 13 wherein said difference in elevation being about 0.005 to 0.008 inch.

15. The can end of claim 7, wherein said generally flat radially extending portion comprises a deboss panel, wherein the tab and the score panel are positioned within said deboss panel.

* * * * *